US007999752B2

(12) United States Patent
Riedel

(10) Patent No.: US 7,999,752 B2
(45) Date of Patent: Aug. 16, 2011

(54) DIPOLE SHAPED RADIATOR ARRANGEMENT

(75) Inventor: Matthias Riedel, Stephanskirchen (DE)

(73) Assignee: Kathrein-Werke KG, Rosenheim (DE)

( * ) Notice: Subject to any disclaimer, the term of this patent is extended or adjusted under 35 U.S.C. 154(b) by 339 days.

(21) Appl. No.: 12/438,247

(22) PCT Filed: Aug. 2, 2007

(86) PCT No.: PCT/EP2007/006863
§ 371 (c)(1),
(2), (4) Date: Feb. 20, 2009

(87) PCT Pub. No.: WO2008/022703
PCT Pub. Date: Feb. 28, 2008

(65) Prior Publication Data

US 2010/0007571 A1 Jan. 14, 2010

(30) Foreign Application Priority Data

Aug. 22, 2006 (DE) ..... 10 2006 039 279

(51) Int. Cl.
*H01Q 21/26* (2006.01)

(52) U.S. Cl. ..... 343/797; 343/795

(58) Field of Classification Search ..... 343/795, 343/797
See application file for complete search history.

(56) References Cited

U.S. PATENT DOCUMENTS

| | | | | |
|---|---|---|---|---|
| 3,740,754 | A * | 6/1973 | Epis | 343/797 |
| 4,042,935 | A * | 8/1977 | Ajioka et al. | 343/795 |
| 4,218,685 | A * | 8/1980 | Frosch et al. | 343/727 |
| 4,668,956 | A | 5/1987 | Mahnad | |
| 5,929,820 | A * | 7/1999 | Caulfield et al. | 343/761 |
| 7,710,342 | B2 * | 5/2010 | Schadler et al. | 343/797 |
| 2004/0201537 | A1 | 10/2004 | Stolle et al. | |
| 2005/0134517 | A1 | 6/2005 | Gottl | |

FOREIGN PATENT DOCUMENTS

| | | |
|---|---|---|
| DE | 196 27 015 | 1/1998 |
| DE | 197 22 742 | 12/1998 |
| FR | 2 840 455 | 12/2003 |
| WO | WO 00/39894 | 7/2000 |
| WO | WO 2004/100315 | 11/2004 |
| WO | WO 2005/060049 | 6/2005 |

OTHER PUBLICATIONS

International Search Report for PCT/EP2007/006863, mailed Oct. 8, 2007.

German-language International Preliminary Report on Patentability for PCT/EP2007/006863, dated Dec. 16, 2008, including 5 Amended Sheets.

* cited by examiner

*Primary Examiner* — David G Phan
(74) *Attorney, Agent, or Firm* — Nixon & Vanderhye PC

(57) ABSTRACT

An improved dipole-shaped radiator arrangement is characterized by the following features: a base is disconnected from ground or a ground surface with respect to direct current, or is capacitively coupled to a ground surface; a first dipole or radiator half is electro-galvanically or capacitively fed by a conductor; a second dipole or radiator half is fed via a further feed line in the form of an inner conductor feed; the one end of the first inner conductor section is electrically connected to a matching network; the other end of the third inner conductor section is connected to ground or to the ground surface with respect to direct current.

13 Claims, 3 Drawing Sheets

DIPOLE SHAPED RADIATOR ARRANGEMENT

CROSS REFERENCE TO RELATED APPLICATIONS

This application is the U.S. national phase of International Application No. PCT/EP2007/006863, filed 2 Aug. 2007, which designated the U.S. and claims priority to German Application No. 10 2006 039 279.5-55, filed 22 Aug. 2006, the entire contents of each of which are hereby incorporated by reference.

The invention relates to a dipole-shaped radiator arrangement according to the preamble of claim 1.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

FIELD

Dipole antennas are known for example from the prior publications DE 197 22 742 A and DE 196 27 015 A. Dipole antennas of this type may have a conventional dipole construction or, for example, be formed from a crossed dipole or a dipole square, etc.

BACKGROUND AND SUMMARY

What is known as a vector dipole is known for example from the prior publication WO 00/39894. The construction thereof appears to be comparable to a dipole square. However, owing to the specific configuration of the dipole antenna in this prior publication and the particular way of feeding this dipole antenna, it operates in a similar manner to a crossed dipole which radiates in two polarization planes which are perpendicular to one another. In terms of its construction, it is rather square-shaped as a result of the outer contour configuration thereof in particular.

WO 2004/100315 A1 discloses a further configuration of the aforementioned vector dipole, in which the entire faces of each radiator half of one polarization can be closed to a large extent.

Dipole antennas of this type are conventionally fed in such a way that one dipole or radiator half is DC connected (i.e. galvanically) to an outer conductor, whereas the inner conductor of a coaxial connection cable is DC connected to the second dipole or radiator half (i.e. again galvanically connected). In each case, power is fed to the end regions of the dipole or radiator halves facing towards one another.

It is known from WO 2005/060049 A1 to feed the outer conductor by means of a capacitive outer conductor coupling. The support means or each associated half of the support means of the radiator arrangement can for this purpose be coupled to ground capacitively at the foot region or the base of the support means (in this case the outer connector of a coaxial feed line is generally preferably connected electrogalvanically to the reflector underneath the base of the support means).

A conventional, i.e. known from the prior art, feed means of a dipole of this type is shown in a sectional view in FIG. 1*a*, in particular for a radiator arrangement 1 which is specifically composed of a dipole 1' and also comprises two radiator halves 1*a* or 1*b*, i.e. specifically two dipole halves 1'*a* and 1'*b*. The sectional view in FIG. 1*a* shows that this radiator arrangement 1 can be arranged on a reflector 105 for example in such a way that the radiator arrangement 1 is DC (i.e. galvanically) connected, via its base 7 at the bottom thereof, to an electrically conductive reflector 105 (which forms the ground or ground surface 5). A capacitive coupling can be produced if an insulating layer 21 is arranged between the base 7 and the reflector 105. If the electrically conductive base of the radiator device is galvanically isolated from the ground or reflector surface by an insulating layer, an electrogalvanic connection to the support means can, if desired, be produced by DC (i.e. galvanically) coupling the base 7 of the support means 9, which supports the dipole halves 1'*a*, 1'*b*, to ground.

Likewise, the half 9', shown for example on the left in FIGS. 1*a* and 1*b*, of the support means 9 (which is formed as a hollow cylinder in the embodiment shown) could be extended through a hole in the reflector to the lower side or rear of the reflector or could at least terminate in the region of the recess or hole in the reflector in such a way that (when the support means is galvanically isolated from the reflector, for example by using an insulator provided between the reflector and the base of the support means of the radiator device) a first feed line (in particular in the form of an outer conductor of a coaxial cable) is in this case preferably electrogalvanically connected to one half 9' of the support device 9 at the height of the conductor plane or the reflector in order to thereby feed the first dipole or radiator half 1*a*, 1'*a* as is known from WO 2005/060049 A1.

As can be seen from FIG. 1*a* and from the cross-section in FIG. 1*b* (FIG. 1*b* thus being a cross-section along the line II-II in FIG. 1 and again showing a dipole antenna known from the prior art), an axial hole 11', which ultimately represents an outer conductor of a coaxial line, is provided in one of the rather tubular halves 9' of the support means 9, an inner conductor 13 for feeding the radiator arrangement extending from the rear of the reflector in the direction of the second radiator half 1*b* in a feed plane 15 which is at a distance from the reflector plane or the base 7 of the radiator arrangement and is located closer to the radiator halves 1*a* and 1*b* and in which the inner conductor 13 can be DC connected, i.e. galvanically, to the second radiator half 1*b* at the feed point 17 for example. If an outer conductor were laid instead, i.e. a coaxial feed cable were used, the outer conductor of a coaxial cable of this type would be arranged for example in the hole 11', the outer conductor then being able to be galvanically connected to the first radiator half 1*a*, for example at the approximate height of the feed plane 15. However, as mentioned, the half 9' in question of the support means 9 may itself be used as an outer conductor line.

In a modified embodiment disclosed in WO 2005/060049, an axial hole 11" is also provided in the second half 9" of the support means 9 in such a way that a coaxial line arrangement is again formed, namely with an inner conductor 13 which extends from a matching network on the lower side of the reflector 105 via the first hole 11' in the first half 9' of the support means 9, thus forming a first inner conductor portion 13*a*, the inner conductor 13 then transitioning via an inner conductor or connection portion 13*b*, which extends at least approximately parallel to the reflector 105, into a third inner conductor portion 13*c* which passes from above into the second hole 11" of the second half 9" of the support means 9 and terminates freely approximately in the lower third of the support means 9 without contacting the electrically conductive support means 9. This is preferably achieved by using an insulator which is inserted in the holes 11', 11" is penetrated by the inner conductor 13 and is held thereby. In other words, the central inner conductor portion 13*b* is not galvanically connected to the associated dipole half 1*b*, 1'*b* at the feed point 17 but an inner conductor coupling is formed at this point instead.

A further device of the prior art is known from U.S. Pat. No. 4,668,956. This prior publication discloses a dipole antenna which in one embodiment comprises two dipole halves and in a further embodiment comprises two dipoles which are positioned so as to be offset relative to one another by 90°. Each dipole antenna comprises a tubular support means which is electrogalvanically connected to the reflector. Guided inside this support means, which serves as an outer conductor, is an inner conductor which projects from the rear of a hollow cylindrical support means and is fed at that point. At the height of the dipole halves, the inner conductor is guided approximately parallel to the reflector plane in the direction of the second half of the hollow cylindrical support means so as to then run back towards the reflector inside the second hollow cylindrical support means. The inner conductor terminates therein at a distance from the reflector plane and is electrogalvanically connected to the hollow cylindrical, electrically conductive support half via a short circuit element.

An electrogalvanically conductive lug, which projects parallel to the reflector plane and on which the dipole halves engage, is arranged on each of the two hollow cylindrical support means at the height of the end remote from the reflector.

The object of the present invention is to form, on the basis of the prior art mentioned at the outset, a dipole-shaped or dipole-like radiator arrangement which achieves even greater bandwidth.

The object is achieved according to the invention by the features specified in claim 1. Advantageous embodiments of the invention are specified in the sub-claims.

According to the invention, it is now provided that the inner conductor, which in the state of the art terminates freely inside the second half of the support means, is extended and DC connected (i.e. galvanically) to ground potential. In other words, one of the ends of the inner conductor is connected to the feed network (as in the prior art), whilst the other end of the inner conductor is now DC connected to ground.

This completely astonishing construction enables a marked improvement in the bandwidth of a radiator of this type to be achieved. In this case, the radiator is fed by a non-galvanic inner conductor feed means, it thus being possible to also use different materials (such as aluminium, a plastics material provided with a metal-coated surface, etc.) for the radiator, since no solder connections are required.

In contrast to the solution according to U.S. Pat. No. 4,668,956, the invention is based on a dipole-shaped or dipole-like radiator arrangement which radiates for example in one or two polarization planes, the radiator arrangement, comprising the dipole and/or radiator halves and the support means, including the base, as a whole being electrically conductive, but is nevertheless galvanically isolated via the reflector or ground plane, i.e. is preferably capacitively coupled to the ground or reflector surface. In addition, the end of the inner conductor, which is guided back towards the ground or reflector surface (i.e. the end opposite to that to which an appropriate signal is fed), is, according to the invention, not electrogalvanically connected to the support means, which is hollow cylindrical in form for example and encloses the inner conductor, but is connected to the ground and/or reflector surface.

In a particularly preferred embodiment, the base of the support means of the radiator arrangement is capacitively coupled to the reflector or to ground.

However, it is also possible to connect the base of the support means of the radiator galvanically to the reflector or ground.

Even if the base of the support means of the radiator arrangement is coupled capacitively to ground or to the ground surface, the length of the inner conductor and thus the height of the feed plane which is at a distance from the reflector or ground plane is generally selected in such a way that said feed plane is approximately at the height of the dipole or radiator halves. This feed plane is often positioned somewhat lower. The feed plane may for example preferably be located at any height between $\lambda/10$ below the radiator plane and $\lambda/6$ above the radiator plane, preferably however not more than $\lambda/10$ above the radiator plane. In this case, $\lambda$ represents a wavelength of the frequency band to be transmitted, preferably approximately the average wavelength of the frequency band to be transmitted.

The height of the radiator may be in the conventional range of $\lambda/4$ over ground (i.e. the reflector or ground). This height should in any case preferably not fall below a value of $\lambda/10$. In principle, there is no upper limit so the radiator height may in principle be any desired multiple of $\lambda$ (especially since a radiator has a radiation pattern even if there is no reflector). However, $\lambda$ preferably only represents a wavelength from the frequency band to be transmitted, preferably at an average frequency of the frequency band to be transmitted.

BRIEF DESCRIPTION OF THE DRAWINGS

The invention will be described in greater detail below with reference to an embodiment. In the figures.

DETAILED DESCRIPTION

Figure 1A:
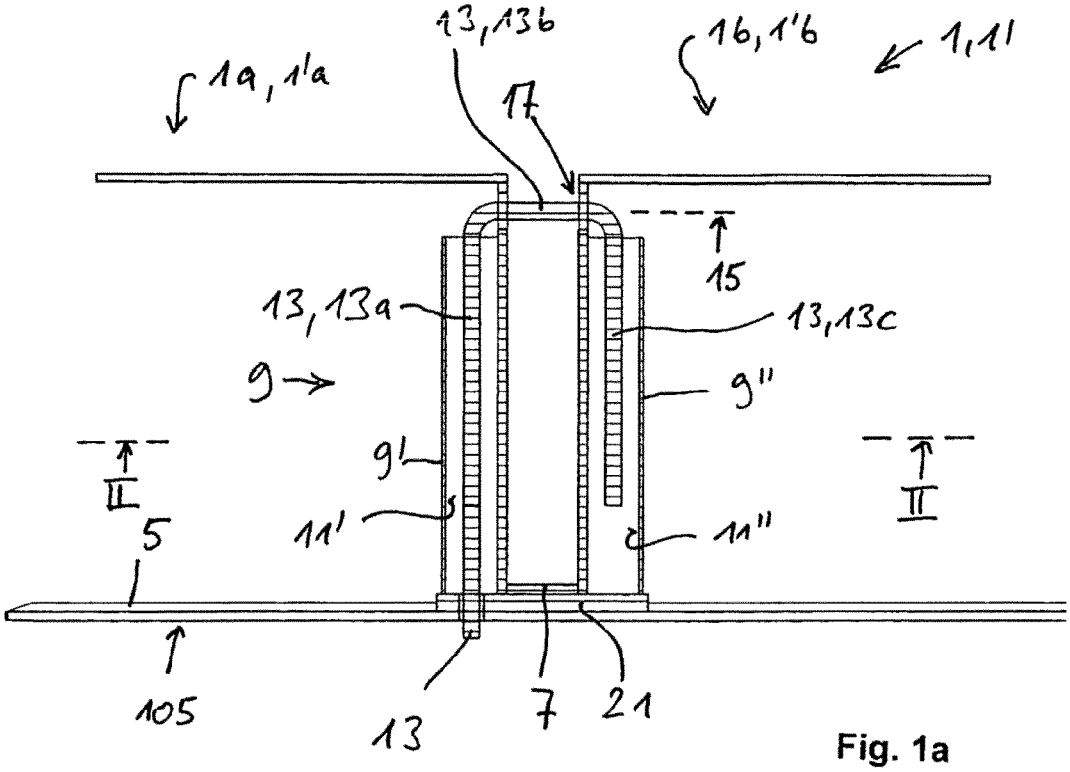
Fig. 1a (PRIOR ART)
FIG. 1*a*: is an axial sectional view through a dipole according to the prior art comprising a conventional feed means.
Figure 1B:
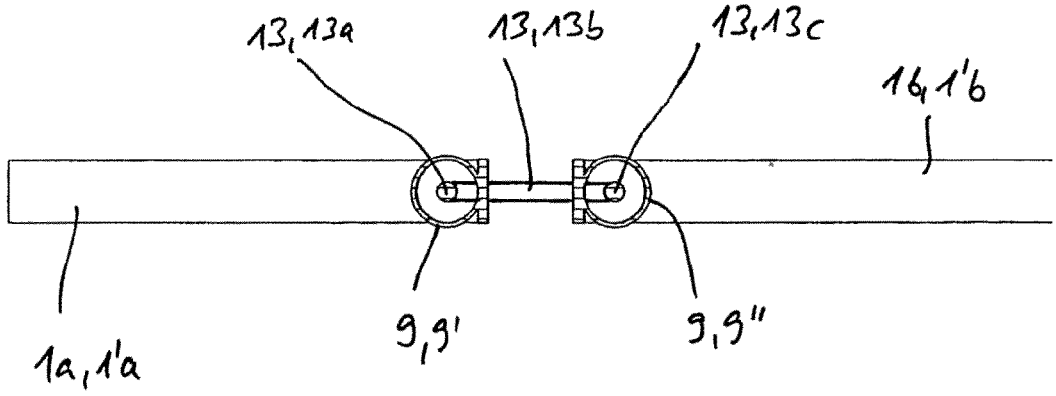
Fig. 1b (PRIOR ART)
FIG. 1*b*: is a cross-section along the line II-II in FIG. 1*a* of the dipole antenna known from the prior art.
Figure 2:
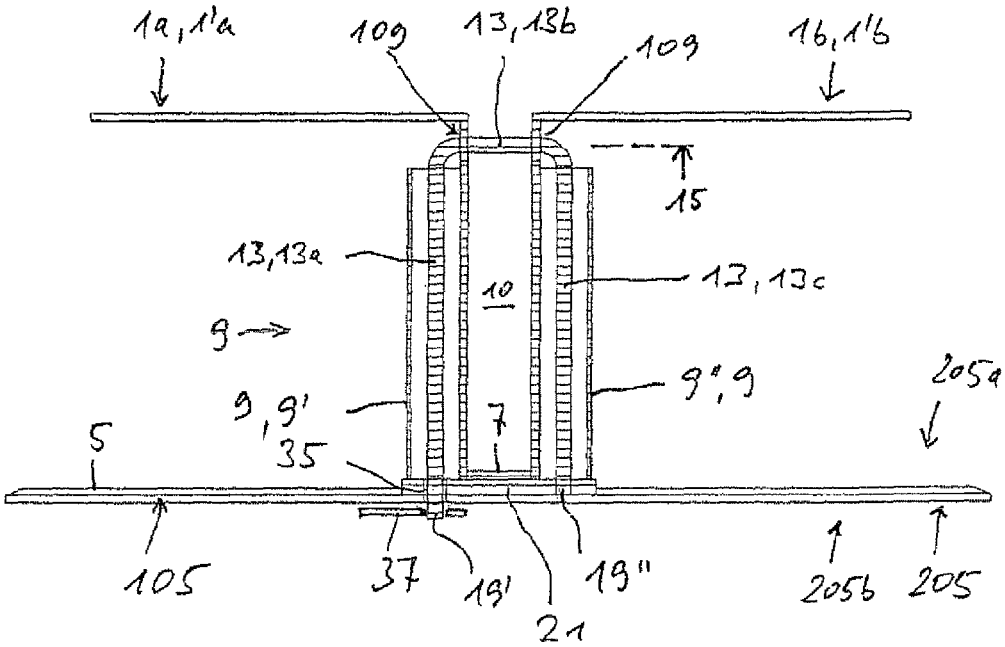
FIG. 2: is a cross-section through a dipole comprising an inner conductor feed means according to the invention.

The construction of a dipole-shaped radiator 1 is shown in FIG. 2, the reference numerals provided with reference to FIG. 1 specifying like or similar components.

The embodiment according to the invention shown in FIG. 2 differs from that shown in FIGS. 1*a* and 1*b* firstly in that the radiator device, including the radiator and/or dipole halves and the associated support means, is not electrogalvanically connected to the associated base but is always isolated from the ground or reflector surface. However, there may be preferably be a capacitive coupling between the ground or ground surface, i.e. in particular the reflector surface, and the support means.

Secondly, the embodiment according to the invention shown in FIG. 2 further differs from that in FIGS. 1*a* and 1*b* in that the inner conductor 13 does not terminate freely in the second support half 9", but is extended so as to reach the plane of the reflector 105 and is DC, i.e. galvanically, connected, via the inner conductor end 19" thereof to the ground surface 5 which is formed either by the electrically conductive reflector 105 or by an electrically conductive ground surface 5 on a printed circuit board 205, i.e. an electrically non-conductive substrate (dielectric). The ground surface 5 is conventionally formed on the radiator side 205*a*, and provided on the opposite side 205*b*, which forms the lower side, is the matching network 37, to which the further end 19' of the first inner conductor portion 13*a* is electrically connected and attached.

In this embodiment, it is indicated that the base, which is electrically conductive or provided with an electrically conductive coating, of the support means 9 (which shall be referred to at some points below as the support 9) is capacitively coupled to the ground surface 5, for which purpose a sheet-shaped, plate-shaped or film-shaped insulator 21 is provided between the lower side of the base 7 of the dipole radiator 1 and the ground surface 5 or the reflector 105.

The inner conductor 13 is guided over its entire length 13 in such a way that it is electrogalvanically isolated from the support 9 in a conventional manner by inserting insulator sleeves, through which the inner conductor 13 passes, in the axial holes 11' and 11". This ensures that there is no direct current (galvanic) contact between the inner conductor 13 and the electrically conductive support 9.

For this purpose, holes or passages 109 are formed on the upper end of the support means 9 in order to guide the inner conductor from one half 9' of the support means 9 transversely to the other half 9" of the support means 9 along what is known as the feed plane 15, the inner conductor penetrating the axial hole 11" of the second support half 9" from above.

In this way, in accordance with the embodiment according to FIG. 2, the position of the line portion, which extends substantially parallel to the ground surface, of the central or second inner conductor portion 13*b* is defined relative to the ground or reflector plane as the feed plane 15. However, this central inner conductor portion 13*b* must not necessarily run parallel to the ground or reflector plane. It may also be provided with a central raised portion or a central recess, when viewed from the side, between the curved or transition regions to the first and third line portions 13*a* and 13*c* (which extend in the two support halves 9' and 9") in order to create space for a central line portion, extending transversely thereto, for a second polarization plane if, for example, a dipole antenna which radiates in two polarization planes perpendicular to one another is used. For this reason, either the position of the central portion of the second inner conductor portion 13*b*, which preferably extends parallel to the ground or reflector plane, or the central point of this central inner conductor portion 13*b* can be used in order to define what is known as the feed plane 15.

As is also shown in the embodiment in FIG. 2, the two support halves 9' and 9" are separated from one another by a slot 10 extending from the top towards the bottom and are connected to one another only by the base 7 at the bottom. This unit, formed of the two support halves 9' and 9" and the base 7, may be produced entirely from a conductive metal, for example a metal cast component. It is also possible for the two support halves 9' and 9", including the associated base 7 thereof, to be produced from an electrically non-conductive material, for example a dielectric, plastics material, etc. In this case, the surface is generally completely coated or covered with an electrically conductive layer, in particular a metal coating which not only covers the outer faces, but also the surface of the holes 11' and 11" in the support halves 9' and 9", thus forming coaxial line portions with the inner conductor laid therein. In this case, the dipole or radiator halves 1*a* and 1*b*, which are located in the radiator plane, are preferably also integrally connected to the support halves 9' and 9", i.e. they are produced in one piece. If the entire construction is not produced from an electrically conductive material, the dipole and/or radiator halves 1*a* and 1*b* are also preferably coated with the electrically conductive, preferably metal, layer. In other words, the dipole and/or radiator halves of the associated support means, including the support halves and the base, are all configured so as to be electrogalvanically conductive and/or are electrogalvanically connected.

Figure 3:
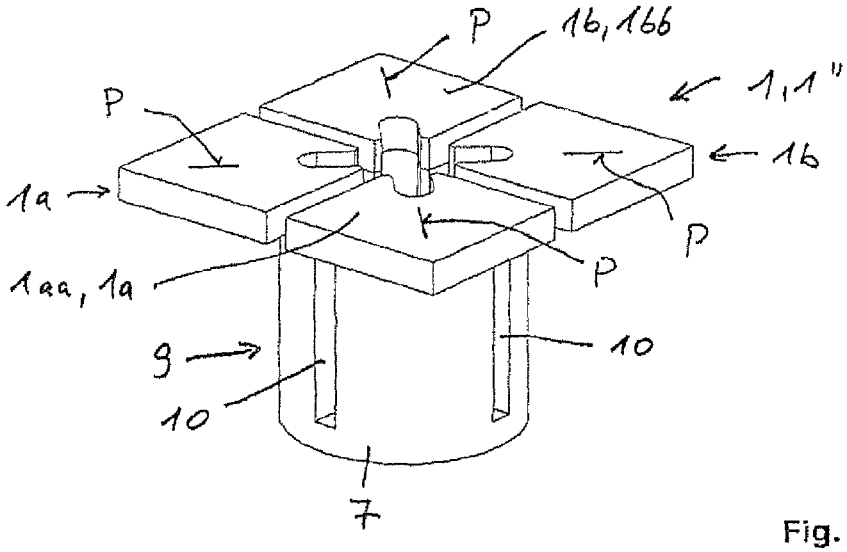
FIG. 3: is a three-dimensional view of a dual-polarized radiator, in the interior of which an inner conductor feed means according to the invention is provided.

A dual-polarized radiator 1", the mode of operation of which is known in principle from WO 00/39894 A1, WO 2004/100315 A1 and WO 2005/060049 A1, is shown in a three-dimensional view in FIG. 3. This is what is known as a vector dipole 1", which radiates in two polarization planes which are perpendicular to one another. The two polarization planes P are indicated schematically in FIG. 3. They extend in a known manner through the corners of the radiator arrangement, configured in plan view in a similar manner to a dipole square, and thus forming two pairs of radiator halves 1*a* and 1*b* respectively which are offset by 90°, the second pair of radiator halves. 1*a* and 1*b*, which are additionally denoted with the reference numerals 1*aa* and 1*bb*, each being fed by an appropriately arranged inner conductor feed means.

Figure 4:
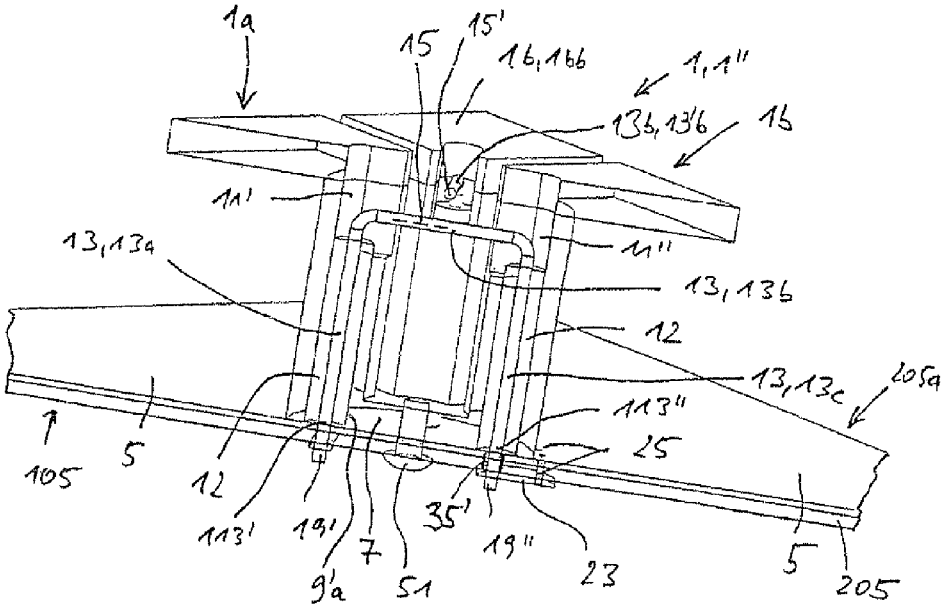
FIG. 4: is a sectional view through the embodiment according to FIG. 3.

In the sectional view shown in FIG. 4, the sectional plane extends along a polarization plane P.

It can be seen that the configuration and arrangement of the inner conductor 13 in relation to the polarization plane is similar to that of the radiator arrangement 1 in the form of a simple dipole 1' which was explained with reference to FIG. 2. According to this embodiment, the first inner conductor portion 13*a* of the inner conductor 13 extends in an axial hole 11' of the first support half 9', where it is preferably isolated with respect to direct current from the support means 9 by an insulating sleeve 12.

At the upper end of the insulating sleeve, the second inner conductor portion 13*b* extends at a right angle to the first inner conductor portion 13*a*, i.e. parallel to the plane of the ground surface 5 or of the reflector 105 and therefore also parallel to the radiator halves 1*a*, 1*b*, towards the second support half 9", where the inner conductor passes into its third inner conductor portion 13*c* which in turn extends parallel to the first inner conductor portion 3*a*, i.e. approximately at a right angle to the second inner conductor portion 13*b*, and is thus arranged at a right angle to the ground surface 5.

At its lower end 19', the first inner conductor portion 13*a* is again guided through a hole 35 (as shown in FIG. 2) in the direction of the reflector 105 or the ground surface 5 and is preferably electrically connected at the rear or lower side thereof to the aforementioned matching network 37, via which the inner conductor is fed.

In this embodiment, the second end 19" of the inner conductor 13 in the second support half 9" is also guided through the reflector 105 or the printed circuit board 205 via a hole 35' with no electrical contact and, at the rear of the electrical circuit board 205, is DC (i.e. galvanically) connected to the ground surface 5 provided on the radiator side 205*a* via an electrical connection 23 and a plurality of subsequent feedthroughs 25. The aforementioned electrical connection 23 may in this case be formed so as to be planar, but may also assume any other shape Likewise, the inner conductor may also be galvanically connected directly to the ground surface 5 on the upper side of the printed circuit board (as shown in FIG. 2). The connection with the ground surface 5 via an electrical connection 23 formed on the rear of the printed circuit board has only been selected in the embodiment shown for ease of production.

The feed plane 15 is in this case again represented (at least approximately) by the central inner conductor portion 13*b*.

In a vector radiator, as shown in a sectional view in FIG. 4, two radiator halves 1*a*, 1*b* (or 1*aa*, 1*bb*) are provided for each polarization plane P, each radiator half being mechanically and electrogalvanically connected to an associated support half 9' and the two pairs of support halves 9', 9", which are each offset relative to one another by 90°—corresponding to the respective polarization planes P which are offset relative to one another by 90°—are electrogalvanically connected to one another by their common base 7 located at the bottom thereof. As previously mentioned, the components are preferably in this case arranged in such a way that—especially if the ground surface 5 is formed by an electrically conductive reflector 105—an insulator 21 is positioned between the electrically conductive base 7, the support means 9 and the ground surface 5 so that the base 7 is not contacted with respect to direct current by the ground surface 5, i.e. there is no galvanic connection.

If the ground surface 5 is formed on a substrate 205 for example, said ground surface can also be covered with an insulating coating layer in such a way that a capacitive coupling is formed between the conductive base 7 of a radiator assembled thereon and the ground surface 5 which is isolated by the coating layer.

With respect to the radiator halves 1*a* and 1*b* shown in section in FIG. 4 and the polarization plane P lying in the drawing plane, the support half 9" shown on the right in the section, from the height of the radiator plane, also taking into account the base 7, up to the contact point 9'*a*, at which the right support half 9" is electrically connected to the base 7, could be interpreted as a balancing means for this polarization plane. The same applies to the embodiment in FIG. 2.

Since the embodiment shown in FIGS. 3 and 4 is a dual polarized radiator, the construction of the second support means 9, which is offset by 90° and comprises the associated support halves 9', 9" for the second polarization plane B, is identical, in this case the inner conductor 13, i.e. the two inner conductor portions 13*a* and 13*c*, which extend in the support halves, being formed so as to extend slightly further (or less) in the longitudinal direction in comparison with the support means 9, which is offset by 90°. Consequently, each of the central inner conductor portions 13*b* (which in each case connect the two inner conductor portions 13*a*, 13*c* which extend parallel to one another) lie in feed planes 15' which are slightly offset from one another. As a result, the two central inner conductor portions 13*b* extend at different heights relative to the ground surface 5, where they cross in a contactless manner. In the sectional view according to FIG. 4, the corresponding central inner conductor portion 13*b*, which is additionally provided with the reference numeral 13'*b* in this case, for the second polarization plane can be seen. Alternatively, one of the crossing inner conductor portions 13*b* of one polarization plane could comprise a central portion which inclines upwards and the second central inner conductor portion, crossing therewith, for the second polarization plane comprises a portion which curves downwards in such a way that the two inner conductor portions can cross in a contact free manner, whilst using first and third inner conductor portions 13*a* and 13*b* which are of the same overall length.

The described construction with the inner conductor arrangement according to the invention enables the two ends 19' and 19" to be guided to the rear of the reflector 105 or the rear or underside of a dielectric substrate 205. This also enables the dipole radiator to be mechanically fixed for example, by soldering one feed end 19' of the inner conductor 13 to the matching network 37 on the rear of the reflector 105 or the substrate 205, and soldering the second end 19" of the inner conductor 13 to the aforementioned electrical connection 23 by means of which the connection to the ground surface 5 on the radiator side of the substrate 205 is produced via subsequent feedthroughs 25.

In addition, however, a screw connection may also be used, for example by using a screw 51, which can be electrically conductive or non-conductive depending on whether it is used capacitively or galvanically and is screwed into the base from the rear of the reflector or substrate. Adhesive or double-sided adhesive tape or adhesive film may also be provided between the lower side of the base and the upper side of the reflector or substrate to fix the radiator arrangement.

The length of the inner conductor 13, i.e. the length of the inner conductor portion 13*a* or 13*c*, should extend from a respective lower end 113' or 113" at the height of the ground surface 5 to the height of the feed plane 15 or 15' and be of a length which is for example no more than $\lambda/10$ below the radiator plane defined by the radiator halves 1*a* and 1*b* (or dipole halves 1'*a* and 1*b*) and no more than $\lambda/6$ above this radiator plane. It is particularly beneficial for the feed plane to be no more than $\lambda/10$ below the radiator plane and no more than $\lambda/10$ above the radiator plane. In this case $\lambda$ represents a wavelength of the frequency band to be transmitted, preferably the average frequency of the frequency band to be transmitted.

Independently thereof; the distance from the radiator or dipole halves 1*a*, 1*b* or 1'*a* or 1'*b* to the ground surface 5 and/or the reflector 105 can be selected in such a way that this distance is preferably approximately $\lambda/4$ over the ground or the reflector. This radiator height should preferably not fall below a value of $\lambda/10$. Using suitable balancing means, feed variants and/or suitable matching networks may enable an even lower radiator plane to be achieved in some circumstances (planar antennas).

Figure 5:
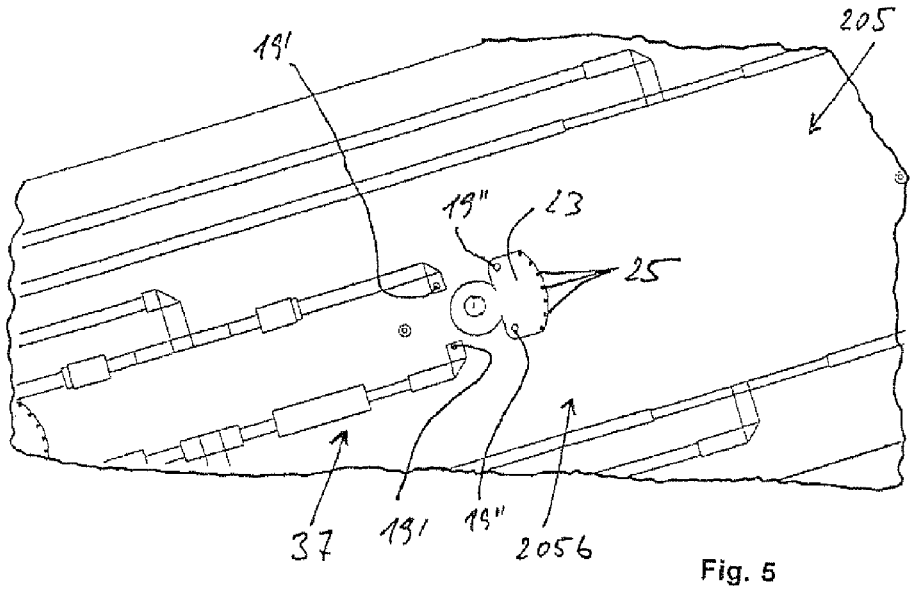
FIG. 5: is a view from below of a matching network on a printed circuit board, on the opposite side of which in the longitudinal direction a plurality of radiators comprising the inner conductor feed means according to the invention are arranged.

The aforementioned matching circuit or matching network 37 is provided in order to be able to carry out suitable matching and transformation processes in the lower end region of the inner conductor 13 or the inner conductor portion 13*a*. FIG. 5 shows a detail of; for example, the reflector 105 or the substrate 205 comprising a matching network 37 as viewed from below. This figure shows the lower connection end 19' of the inner conductor portion 13*a* and the other second end 19" for the two polarization planes, which are connected to ground via the electrical connection means 23 and the subsequent feedthroughs 25.

The invention claimed is:

1. Dipole-shaped radiator arrangement comprising:

at least two dipole or radiator halves for each of the two dipole or radiator halves, an associated support means comprising first and second support halves, an axial hole is formed in each support half, the at least two support halves are connected by a base, in each case a first dipole or radiator half, the associated support halves and the base connecting the two support halves is composed of an electrically conductive material or is coated with an electrically conductive material, the base is isolated with respect to direct current from ground or a ground surface or is capacitively coupled to a ground surface, the first dipole or radiator half is electrogalvanically or capacitively fed by a conductor, a second dipole or radiator half is fed by a feed line in the form of an inner conductor feed means, the inner conductor feed means comprises an inner conductor with a first inner conductor portion which extends in the first support half, a second inner conductor portion which extends in an axial hole in the second support half, the first inner conductor portion, which extends in the first support half, and the second inner conductor portion, which extends in the second support half, being electrically connected by a central inner conductor portion, one end of the first inner conductor portion is electrically connected to a matching network, the other end of the second inner conductor portion is DC connected to the ground surface or a reflector, a printed circuit board provided on the rear or lower side of the ground surface or the reflector, a hole, through which a continuation of the second inner conductor portion is guided, provided in the ground surface or the reflector and in the printed circuit board, and the end of the second inner conductor portion which is guided through the hole is connected to the ground surface or the reflector via an electrical connection.

2. Radiator arrangement as claimed in claim 1, characterized by the following further features:

the central inner conductor portion lies, relative to the ground surface or the reflector, at least over part of the length of the radiator plane or at least at a point in the height of the radiator plane, which is formed by the dipole or radiator halves or in a height range between not more than $\lambda/10$ below this radiator plane and not more than $\lambda/6$ above this radiator plane, $\lambda$ representing a wavelength of the frequency band to be transmitted, preferably the average wavelength.

3. Radiator arrangement as claimed in claim 2, wherein the central inner conductor portion is arranged relative to the ground surface or the reflector at a height above the plane formed by the dipole or radiator halves, and more specifically not more than $\lambda/10$ above this plane, $\lambda$ representing a wavelength of the frequency band to be transmitted, preferably the average wavelength.

4. Radiator arrangement as claimed in claim 1, wherein the distance between the dipole or radiator halves, and the ground surface or the reflector is more than $\lambda/10$ or more than $\lambda/4$, being a wavelength of the frequency band to be transmitted, preferably the average wavelength.

5. Radiator arrangement as claimed in claim 1, wherein a dual-polarized radiator arrangement with two support means which are offset by 90° relative to one another comprises two support halves for each polarization plane (P) with an associated inner conductor feed means, the central inner conductor portions of the two inner conductor feed means crossing in a galvanically isolated manner.

6. Radiator arrangement as claimed in claim 1, wherein the inner conductor portions which are guided in the respective support halves are isolated from the support means by an insulator.

7. Radiator arrangement as claimed in claim 6, wherein an insulating sleeve, in the interior of which the associated inner conductor portion is guided and held, is provided in the axial holes in the support halves.

8. Radiator arrangement as claimed in claim 1, wherein the end of the second inner conductor portion, which is guided through the hole, is connected to the ground surface or the reflector via feedthroughs.

9. Radiator arrangement as claimed in claim 1, wherein the radiator arrangement is held at least indirectly to the printed circuit board provided with the ground surface by said inner conductor which is arranged so as to be at least approximately U-shaped when viewed from the side.

10. Radiator arrangement as claimed in claim 1, wherein said matching network is provided on the side, which is remote from the dipole or radiator halves, of the printed circuit board supporting the ground surface.

11. Radiator arrangement as claimed in claim 10, wherein said hole, through which said continuation of the inner conductor portion extends to the matching network, is provided in the ground surface, the reflector or the printed circuit board.

12. Radiator arrangement as claimed in claim 1, wherein said two dipole or radiator halves are fed via a coaxial cable, the inner conductor of which for feeding one of the dipole or radiator halves forms the inner conductor or is connected thereto, and the outer conductor of which for feeding the other dipole or radiator half is preferably connected to the dipole or radiator half preferably in an electrogalvanic manner via the associated support half or preferably via a capacitive coupling.

13. Radiator arrangement as claimed in claim 1, wherein the inner conductor portions of the inner conductor have the same diameter.

* * * * *